United States Patent [19]

Fesmire et al.

[11] Patent Number: 4,467,530

[45] Date of Patent: Aug. 28, 1984

[54] METHOD AND APPARATUS FOR BATCH CONTINUOUS LAUNDRY PROCESSING

[75] Inventors: Robert H. Fesmire, Barrington Hills; Warren T. Hansen, Glenview, both of Ill.

[73] Assignee: Ellis Corporation, Chicago, Ill.

[21] Appl. No.: 384,928

[22] Filed: Jun. 4, 1982

[51] Int. Cl.[3] ..... F26B 5/08; F26B 11/08

[52] U.S. Cl. ..... 34/8; 34/58; 34/109; 34/56; 34/126; 34/236; 68/210

[58] Field of Search ..... 198/436, 437, 631, 586; 68/210; 34/8, 58, 56, 109, 133, 129, 126, 236

[56] References Cited

U.S. PATENT DOCUMENTS

| | | | |
|---|---|---|---|
| 2,075,012 | 3/1937 | Baker | 198/437 |
| 2,534,286 | 12/1950 | Maitzen | 68/23 |
| 3,945,921 | 3/1976 | Toth | 34/8 |
| 4,194,633 | 3/1980 | Paterson et al. | 198/586 |
| 4,199,871 | 4/1980 | Ward et al. | 34/52 |
| 4,285,219 | 8/1981 | Grunewald | 68/19.2 |

*Primary Examiner*—Larry I. Schwartz
*Attorney, Agent, or Firm*—Mason, Kolehmainen, Rathburn & Wyss

[57] ABSTRACT

A method and apparatus for batch continuous laundry processing involves a system for continuously centrifugally extracting fluids from sequentially received batches of washed laundry. The discrete batches of laundry are continuously received by a conveying apparatus that automatically loads the batches into the discrete compartments defined within the segmented drum of the extractor. While the extractor is rotating, the conveying apparatus arranges a plurality of laundry batches to be quickly loaded into the extractor upon completion of the processing of the previous batches so that the conveying and processing is completely continuous and automatic. The conveying apparatus is vertically, laterally and longitudinally translatable to receive the batches from a washer at one level, to arrange the batches in two rows, and then to automatically feed them, for example two at a time, into the compartments of the segmented extractor. After completion of the extraction cycle, batches of laundry are positively and automatically unloaded from each compartment of the extractor in a continuous fashion and in coordination with the loading of the extractor. In one embodiment of the present invention the batches are centrifugally expelled from the drum upon completion of the extraction cycle. In accordance with another embodiment of the present invention each compartment is unloaded using a translating vacuum suction device. The unloading of the extractor is facilitated by a segmented, reciprocating carrier movable into and out of the laundry drum.

55 Claims, 12 Drawing Figures

METHOD AND APPARATUS FOR BATCH CONTINUOUS LAUNDRY PROCESSING

BACKGROUND OF THE INVENTION

1. Field of the Invention

This invention relates generally to laundry processing and more particularly to an extraction system that processes laundry in discrete batches in a continuous fashion.

2. Brief Description of the Background Art

With the advent of ultra high capacity tunnel washers which are capable of continuously processing enormous quantities of laundry in discrete batches, the need for more advanced systems of extraction for use in conjunction with these washers has grown dramatically. Tunnel washers have a plurality of sections linked by a rotating archimedian screw, so that discrete batches of laundry may be continuously processed through the washer. Currently, membrane presses are used for liquid extraction in conjunction with tunnel washers. Membrane presses have an internal membrane which squeezes the laundry into a compressed state known as a cheese in order to remove the fluid from the washed laundry. Normally, after membrane-type extraction, subsequent drying, for example in a tumble dryer, is required because these extractors are not highly efficient.

Centrifugal extractors with internal drums that rotate at high speed to centrifugally expel the water or other cleaning fluid from the laundry are known to be highly advantageous in terms of energy efficiency and effectiveness of liquid removal. However, centrifugal extractors are not generally believed to be amenable to high capacity or high output continuous processing. Because of the slow speed of operation of centrifugal extractors, current practice requires the use of a plurality of centrifugal extractors to keep up with one high capacity tunnel washer. Moreover centrifugal extractors generally are incapable of accepting and processing discrete laundry batches, other than one at a time. Thus, due to inefficiencies in transferring between the washers and the centrifugal extractors as well as deficiencies in speed of operation and in loading and unloading efficiency, centrifugal extractors have not been found to be satisfactory for use in conjunction with the high capacity tunnel washers.

A significant deficiency in presently known commercial centrifugal extraction systems is that they are prone to developing non-uniform load distributions resulting in load imbalances destructive to the apparatus. In addition after processing in the centrifugal extractor, the laundry is sometimes difficult to remove because it tends to pack along the peripheral surface of the drum. In U.S. Pat. No. 3,945,921 to Toth a system for automatically expelling the laundry after centrifugal extraction is disclosed. After processing, the laundry is raised out of the extractor drum on a reciprocal wall that is still rotating. The laundry is expelled onto a plurality of surrounding conveyors where it is collected for additional processing. Segmented centrifugal extraction drums that divide the laundry into separate portions decreasing the likelihood of developing imbalance problems are known in the art. U.S. Pat. Nos. 3,577,751, 3,570,273, 2,808,153, 2,534,286, and 1,938,146 disclose washing machines or extractors with segmented, rotating drums.

Automatic systems for processing laundry are also known in the art. For example, U.S. Pat. No. 3,844,142 to Miller discloses a hydraulic press extractor which compresses the laundry into a cake. The extractor is used in conjunction with a conveyor system to automatically process laundry received on the conveyor from a washer. In U.S. Pat. No. 4,285,219 issued to Grunewald an apparatus which uses centrifugal extraction and vacuum conveying in conjunction with conventional commercial laundry machines is taught.

SUMMARY OF THE INVENTION

It is an object of the present invention to provide a centrifugal extraction method and apparatus which is capable of continuously and automatically extracting the washing fluid from discrete batches of laundry received from a washer.

It is still another object of the present invention to provide an improved conveyor system for transferring laundry from a washing machine to a centrifugal extractor.

It is another object of the present invention to provide a centrifugal extraction system which is capable of operating in a continuous fashion with batch continuous washers.

It is also an object of the present invention to provide a method and apparatus for facilitating the loading and unloading of centrifugal extractors.

It is yet another object of the present invention to provide such a method and apparatus that lessens the likelihood of extractor load imbalances.

It is still another object of the present invention to provide a method and apparatus for transferring a plurality of discrete laundry batches in a continuous fashion between laundry processing stations.

These and other objects of the present invention are achieved by an apparatus for batch continuous extraction that continuously centrifugally extracts fluid from sequentially received batches of washed laundry. The apparatus includes a centrifugal extractor with a segmented drum divided into a plurality of compartments and a means for rotating the drum. The apparatus also includes means for automatically loading a batch of laundry into each of the compartments and means for automatically displacing the laundry from each of the compartments in the drum after a period of rotation of the drum.

In accordance with another embodiment of the present invention a method for batch continuous extraction involves continuously conveying a plurality of laundry batches from a washing machine to a centrifugal extractor. The batches of laundry are continuously and automatically loaded into each of the compartments in a segmented rotatable centrifugal extraction drum. The drum is rotated for a period of time to remove the fluid from the laundry batches. The laundry is thereafter automatically removed from each of the compartments after a period of rotation is completed.

In accordance with another embodiment of the present invention a batch continuous laundry transfer apparatus for transferring serially received, discrete batches of laundry between spaced laundry processing stations such as a washer and extractor includes a conveying mechanism with a generally horizontal laundry batch receiving surface. Means for automatically translating the mechanism with respect to one of the stations to arrange the serially received discrete batches in at least two side by side rows is provided. Also a means translates the mechanism from a position adjacent the first station to a position adjacent the second station. Means for automatically unloading the laundry batches into second station are included as well.

In accordance with another embodiment of the present invention a method for transferring serially received discrete batches of laundry between spaced processing stations, such as a washer and an extractor, includes the step of arranging a conveying mechanism to receive a plurality of batches of laundry on a surface of the mechanism from a first laundry station. The positioning of a first batch of laundry on the surface is sensed. The mechanism is automatically shifted laterally to receive a second batch of laundry beside the first batch of laundry when the first batch is sensed. The surface is translated to enable the mechanism to receive a second pair of laundry batches on the surface. The laundry is then conveyed from the first station to the second station.

DETAILED DESCRIPTION OF THE PREFERRED EMBODIMENT

Figure 1:
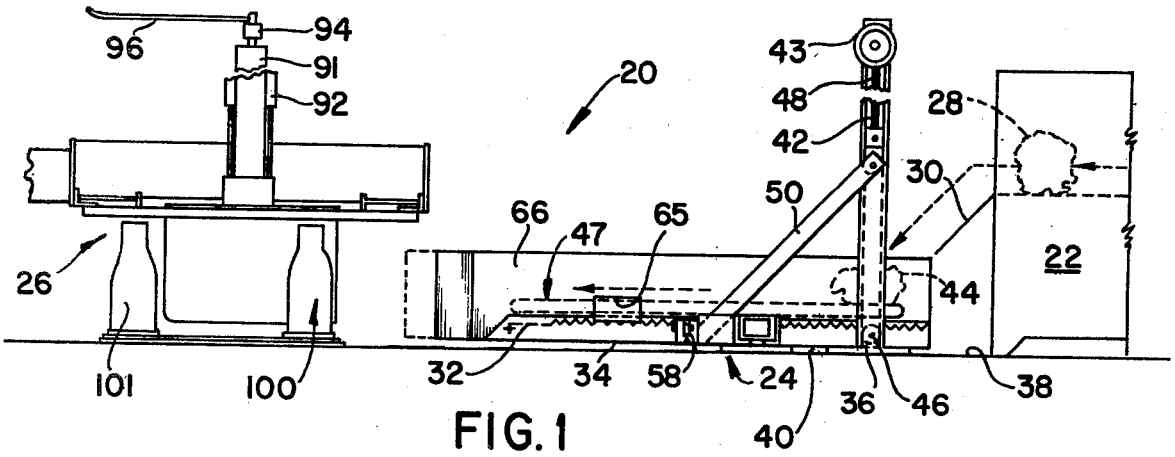
FIG. 1 is a partially sectioned, side elevational view of one embodiment of the present invention in its lowered portion, partially showing a washer arranged to interact with the present invention.

Referring to the drawing wherein like reference characters are used for like parts throughout the several views, a laundry washing and extraction plant 20, shown in FIG. 1, includes a washing machine 22, a laundry transfer apparatus 24 and a centrifugal extractor 26. While the washing machine 22 may take a wide variety of forms, the present invention is highly effective when used with a washer known as a tunnel washer which processes generally equally weighted, discrete batches of laundry in a continuous fashion, conventionally using an extremely large archimedian screw mechanism. After processing in the washing machine 22, the wet laundry batches, indicated as 28, exit from the washing machine 22 onto a slide 30.

Figure 3:
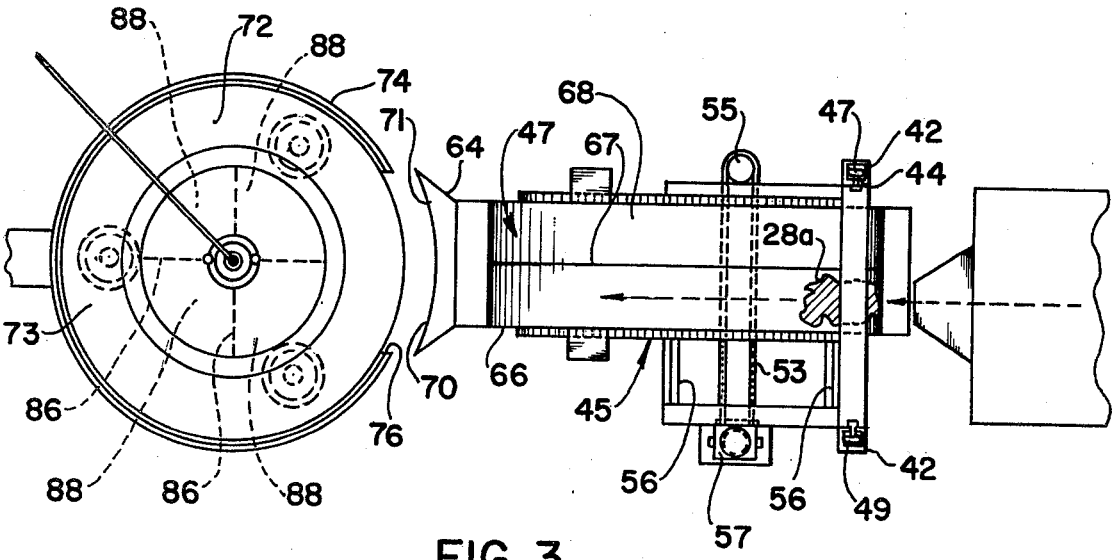
FIG. 3 is a plan view of the embodiment shown in FIG. 1.

The laundry transfer apparatus 24, arranged to receive the batches 28 from the washer 22, includes a generally horizontal, rotatable, endless belt conveyor 32 mounted on a support frame 34. The conveyor 32 includes a translatable platform 36 and a belt assembly 45 mounted on the platform 36. The assembly 45 in turn includes an endless belt subassembly 47 mounted on the assembly 45. The conveyor 32 is mounted to be vertically, laterally, and longitudinally translatable with respect to the support frame 34 and the surface 38 upon which the apparatus 24 rests. More particularly, as shown in FIGS. 1 and 3, the support frame 34 includes a cross member 40, resting on the floor 38, that supports a pair of spaced, vertically extending, slotted posts 42. Each slotted post 42 includes an inwardly facing track 44 which receives a pair of rollers 46 secured to the platform 36 so that the belt conveyor 32 may be translated vertically along the track 44 in each post 42. A winch 43 is connected to the conveyor 32 by a chain 48 to power this vertical translation. The platform 36 is also connected by a pair of angled bars 50 to each of the slotted posts 42. Each bar 50 includes a roller 49 which slides within a track 44 at a position elevated with respect to the position at which the rollers 46 engage the tracks 44. Since the bars 50 are rigidly secured to the conveyor platform 36, the chain 48 may be connected to the bars 50 to translate the conveyor 32 vertically.

As shown in FIG. 3, the conveyor 32 is also laterally translatable since the platform 36 includes a set of tracks 56 that allow the belt assembly 45 to slide laterally or generally perpendicularly to a line connecting the extractor 26 and machine 22. Conveniently a set of rollers 58 secured to the lower side of the belt assembly 45 rollingly engage and are secured within the tracks 56 to make this translation possible and to prevent the assembly 45 from leaving its tracks 56. The lateral translation may be powered by a conventional chain drive including a winch 57 and chain 53 secured to the assembly 45 at one point and supported by a pair of pinions 55 (only one of which is shown).

Figure 7:
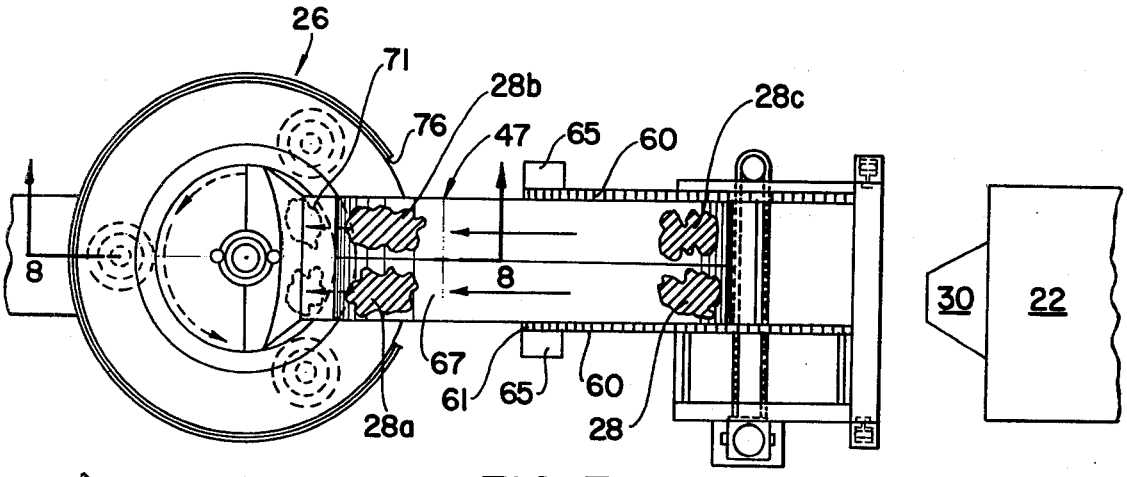
FIG. 7 is a plan view of the embodiment shown in FIG. 6 after the conveying system has been shifted longitudinally.
Figure 8:
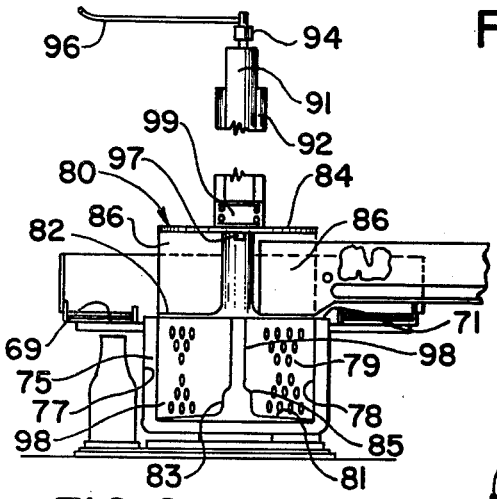
FIG. 8 is a partial cross-sectional view taken generally along the line 8—8 in FIG. 7.

Finally, as shown in FIGS. 7 and 8, the conveyor 32 is longitudinally translatable towards and away from the centrifugal extractor 26. This is due to the mounting of the subassembly 47 on the assembly 45, through a set of transverse, linear rack gears 60. The belt subassembly 47 is supported on the gears 60 by pinions 61 geared for movement with respect to the rack gears 60 in the directions indicated in FIG. 7. The longitudinal translation of the belt subassembly 47 may be powered by a pair of motors 65 mounted on the subassembly 47, each driving a pinion 61.

The belt subassembly 47 includes an inclined, widened front end 64, a pair of upstanding lateral walls 66 and an endless rotatable conveyor belt 68 also forming a part of the subassembly 47. A central upstanding barrier 67 divides the belt 68 into two side by side regions. The free end 70 of the end portion 64 is generally circular, having a radius comparable to that of the extractor 26. A ramp portion 71, adjacent the free end 70, is downwardly inclined and defines an angled ramp. The upstanding walls 66 in conjunction with the end portion 64 guide the batches of laundry 28 received on the apparatus 24 from the washing machine 22 to the centrifugal extractor 26.

Within the extractor 26, as shown in FIG. 8, a rotatable basket 78 has a perforated or liquid permeable cylindrical wall 79 and a base wall 81. The basket 78 is mounted for rotation and the wall 81 includes an inner generally bell-shaped portion 83 terminating in a hub 85 that connects to a motor driven shaft 98. Surrounding the basket 78, an outer casing or enclosure 75, having a generally cylindrical wall 77, conforms to the basket wall 79. A lower surface of base wall 81 supports a conventional bearing assembly (not shown) located within the bell-shaped portion 83. Suitable drain structure (not shown) is provided for liquids extracted from material within the basket 78.

The basket 78 receives a vertically reciprocable carrier 80 translatable between a position totally within the basket 78, as shown in FIG. 3, and a position raised out of and over the basket 78, as shown in FIG. 8. The carrier 80 has a lower surface 82 conforming to the base wall 81 and located closely adjacent to the basket wall 79, an upper horizontal curb 84, and a plurality of vertically arranged dividing walls 86. The walls 86 extend from the upper curb 84 to the lower surface 82, conform to the cylindrical wall 79 and divide the carrier 80 into four distinct compartments 88. Each compartment 88 is pie-shaped and has a generally cylindrical, vertically aligned, open peripheral side 90.

The carrier 80 is raised and lowered by a an actuator assembly 91 mounted on the hub 85 and including a cylindrical sleeve or tube 92. The tube 92 is connected by a rotary union 94 to a source of pressurized fluid through a line 96. The fluid pressure produced in the line 96 is communicated to a chamber (not shown) within the tube 92, thereby translating a piston (not shown) with respect to the chamber. This causes the carrier 80 to be raised to its upstanding position. Upon release of the pressure, the carrier 80 falls to its lower position surrounding the shaft 98. The carrier 80 is frictionally keyed to the shaft 98 to rotate with the basket 78 during extraction. Specifically, the tube 92 frictionally engages the rotating shaft 98 while the carrier 80 frictionally engages the base wall 81 so that the carrier 80 rotates with the basket 78. A suitable mechanism for actuating the carrier 80 is described in U.S. Pat. No. 3,945,921 to Toth hereby expressly incorporated by reference herein in full.

The curb 84 is separable from the remainder of the carrier 80. Normally the curb 84 moves upwardly and downwardly with the remainder of the carrier 80. However, the curb 84 may be independently operated through the pneumatic cylinders 97, mounted on the tube 92, to vertically reciprocate separately of the remainder of the carrier 80. This is conveniently accomplished by providing two passages in the rotary union 94 and line 96, one passage to supply the carrier actuator 91 and the other to supply the pneumatic cylinders 97.

The extractor casing 75 is supported atop three vibration and lateral movement damping suspension pedestal assemblies 100 positioned at regularly spaced positions around the rotational axis of the basket 78. Each pedestal assembly 100 includes a housing portion 101 with a depending internal rod (not shown) attached through the agency of resilient spacers (not shown) to arm members (not shown) radially extending from the casing 75. The suspension pedestal assemblies 100 are described in greater detail in U.S. Pat. No. 3,945,921 to Toth already incorporated by reference herein.

According to one preferred embodiment of the present invention, the centrifugal extractor 26 is surrounded by a circular conveyor 72 encircled by a circular upstanding wall 74. An opening 76 is provided in the wall 74 to allow the transfer apparatus 24 access to the extractor 26, as shown in FIG. 7. The circular conveyor 72 is conveniently a conventional ring conveyor which includes a rotated annular surface 73. A vacuum draw off conveyor 69, extending through the wall 74, is connected to a vacuum source, to remove the laundry from the conveyor 72.

Figure 9:
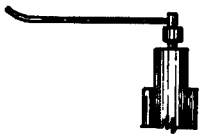
FIG. 9 is a partial, cross-sectional view of another embodiment of the present invention.
Figure 11:
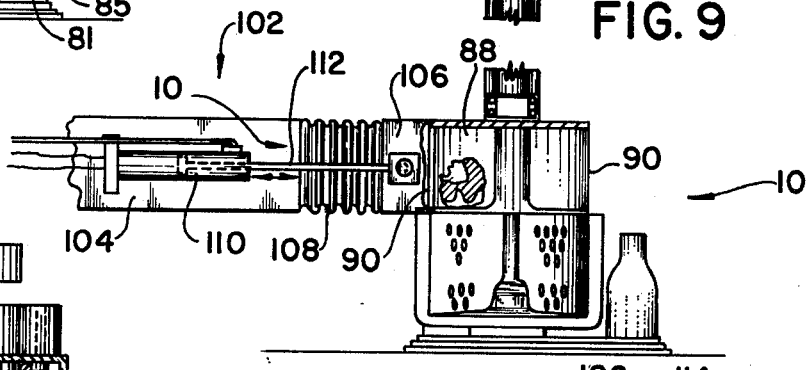
FIG. 11 is a partial cross-sectional view taken generally along the line 11—11 in FIG. 10.
Figure 11:
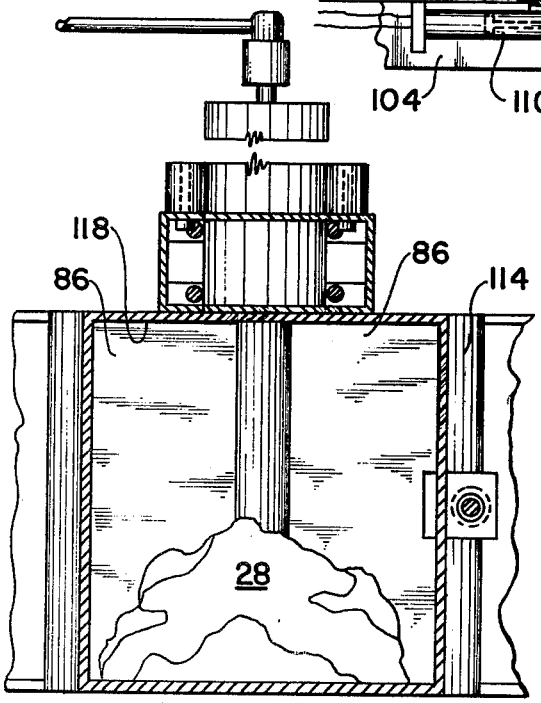
Figure 10:
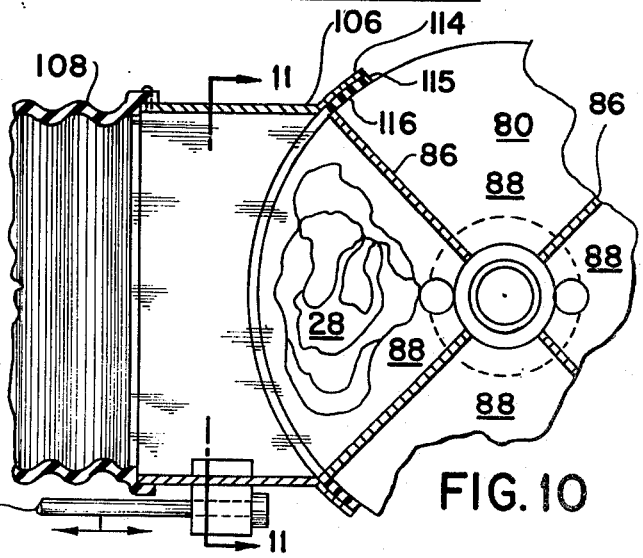
FIG. 10 is a partial cross-sectional view taken generally along the line 10—10 in FIG. 9.

In accordance with another preferred embodiment of the present invention, shown in FIGS. 9–11, a vacuum unloading mechanism 102, that may replace the circular conveyor 72, is provided for unloading the centrifugal extractor 26. The mechanism 102 includes a vacuum conveying duct 104 connected to a vacuum source. The duct 104 is connected to a rigid interface member 106 by means of a flexible, expandable accordian conduit 108. The position of the member 106 with respect to the upwardly translated carrier 80 may be adjusted through the operation of a pair of fluid actuated cylinders 110 mounted on each side of the duct 104 and connected to the interface member 106 by their reciprocating pistons 112. Thus, reciprocation of the pistons 112 results in movement of the member 106 toward and away from the cylindrical open peripheral side 90 of an aligned compartment 88, generally in the direction indicated by the arrows in FIG. 9.

As shown in FIG. 10, the member 106 includes a flared free end portion 114. The portion 114 defines a tubular surface 115 that mates and conforms to the outer periphery of the carrier 80. Secured to the surface 115, a resilient, cylindical, frame-like gasket 116 provides an airtight seal between the member 106 and the open peripheral side 90 of a compartment 88 aligned with the mechanism 102 when the duct 104 is in position adjacent the carrier 80. Thus, as shown in FIG. 11, the flared portion 114 defines a rectangular opening 118 through which a vacuum applied to the duct 104 may be conveyed to the interior of a compartment 88 in sealed relationship with the member 106 and thus the duct 104.

Figure 12:
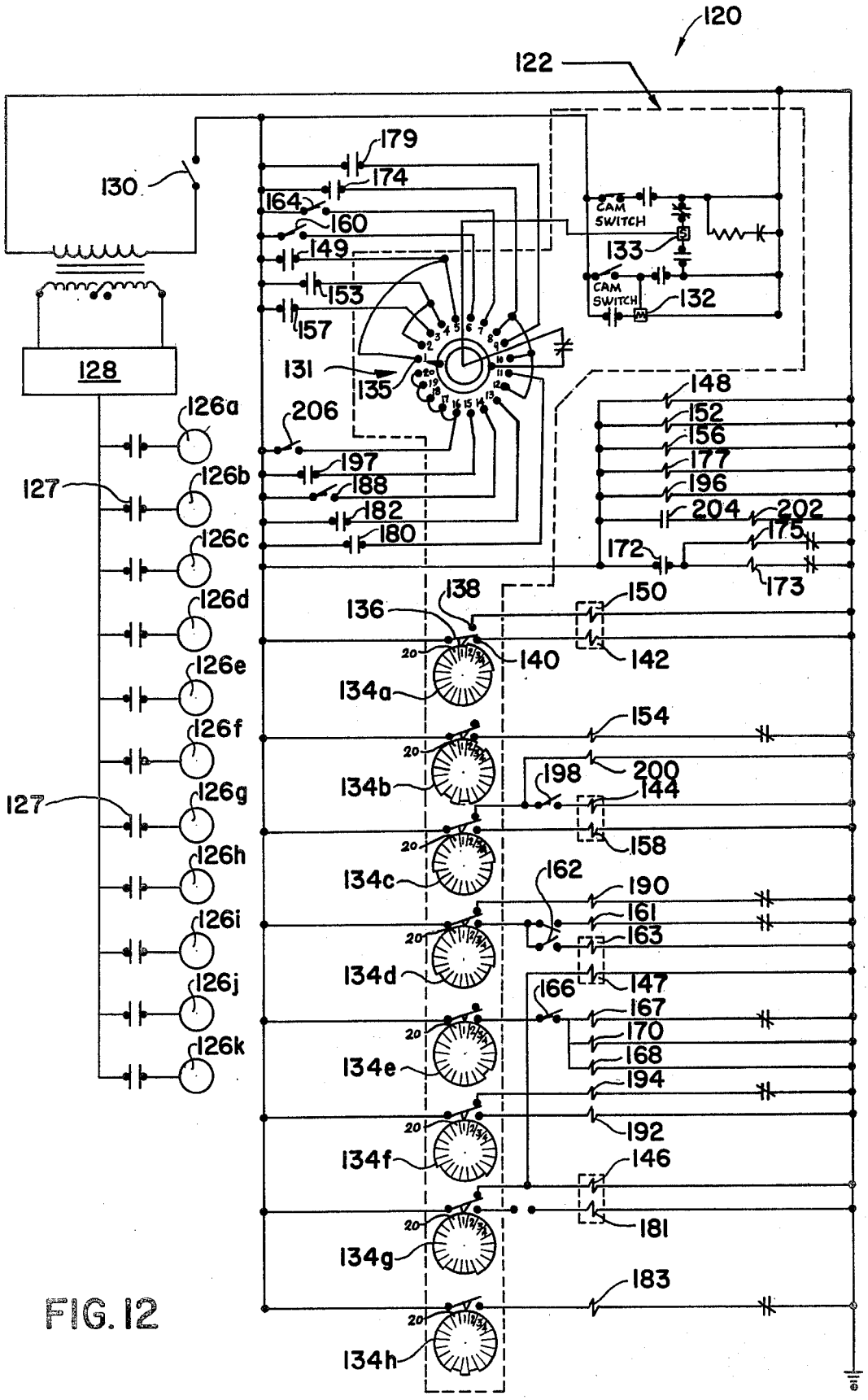
FIG. 12 is a circuit schematic for the embodiment of the present invention shown in FIG. 1.

Referring now to FIG. 12, a motor control circuit 120 includes a step programmer 122 and a relay bank 124 operative to control a plurality of motors 126, responsible for the operation of the plant 20, through the motor switch contacts 127. The motors 126 are connected to the remainder of the circuit 120 by a conventional fuse box 128 and an on-off switch 130. The step programmer 122 includes a rotary stepping switch 131, a stepper or pulse generator 133, a stepping motor 132, and a plurality of cams 134 rotated by the motor 132. The switch 131 and each of the cams 134 in the illustrated embodiment have 20 positions, indicated by slashed radial lines on each cam and partially numbered in FIG. 12. Each cam 134 is arranged to interact with a cam following switch contact 136 pivotable between one of two contacts 138 and 140 arranged at angularly spaced positions near the free end of the contact 136. The contact 136 normally makes a connection with the contact 140 whenever the contact 136 is not displaced by a cam 134. The switch 131 includes a rotary wiper 135, also stepped by the motor 132, that makes an electrical connection with the twenty contacts 137.

With the laundry transfer apparatus 24 in the position shown in FIG. 1, arranged to receive an initial batch of laundry 28 from the tunnel washer 22, the extractor motor 126*j* and the extractor 26 are running, and the cams 134 are in their number one positions. A circuit is completed by the cam 134*a* through the relay 142 responsible for positioning the conveyor assembly 45 in the lateral position shown in FIG. 3. Similarly the cam 134*c* completes the circuit through the relay 144 responsible for positioning the subassembly 47 in its retracted position shown in FIG. 3, closest to the washer 22, and cam 134g is connected through relay 146 to also maintain the oonveyor in its retracted position closest to the washer 22.

Figure 4:
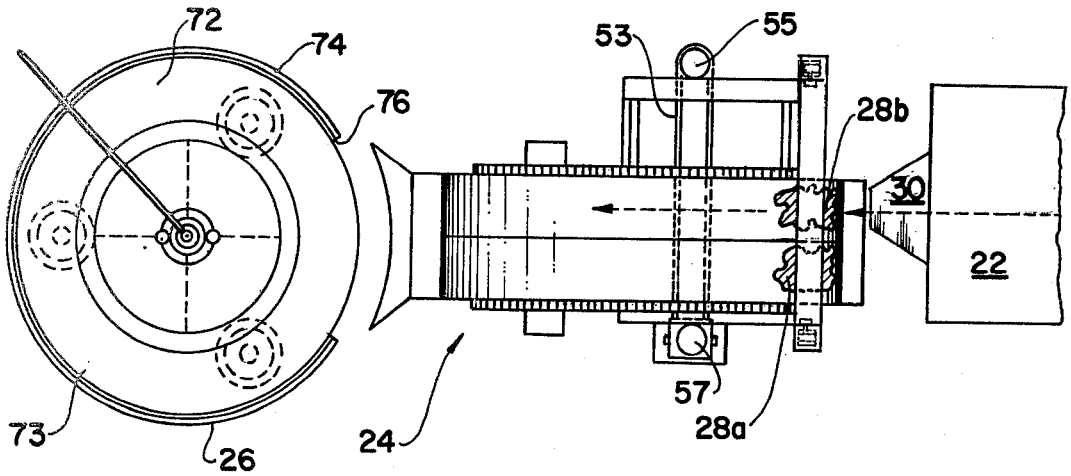
FIG. 4 is a plan view of the embodiment of the present invention shown in FIG. 3 after having been laterally shifted.

When the first batch of laundry 28a is located on the transfer apparatus 24, as indicated in FIG. 3, the photorelay 148 is actuated, closing the switch 149. This completes a circuit through the stepper 131, stepping the motor 132 to position two and causing each of the cams 134 to rotate to their second angular position. When the cam 134a moves to its second position, its contact 136 moves from a position electrically connected to the contact 140 to a position connected to the contact 138. This produces an electrical connection through the contact 136 to the relay 150 responsible for operating the motor 126a that moves the transfer apparatus 24 from the position shown in FIG. 3 to the position shown in FIG. 4. In the position shown in FIG. 4, the transfer apparatus 24 is arranged to receive a second batch of laundry 28b in a position beside the batch of laundry previously received from the washer 22. The movement of the apparatus 24 between the positions shown in FIG. 3 and FIG. 4 is accomplished by operating the winch motor 126a to rotate the pinions 55 and to drive the associated chain 53 to make the required linear translation. When the second laundry batch 28b is positioned on the transfer apparatus 24, the second photorelay 152, located opposite the photorelay 148, is operated, closing switch 153 and stepping the motor 132 to position three.

Figure 5:
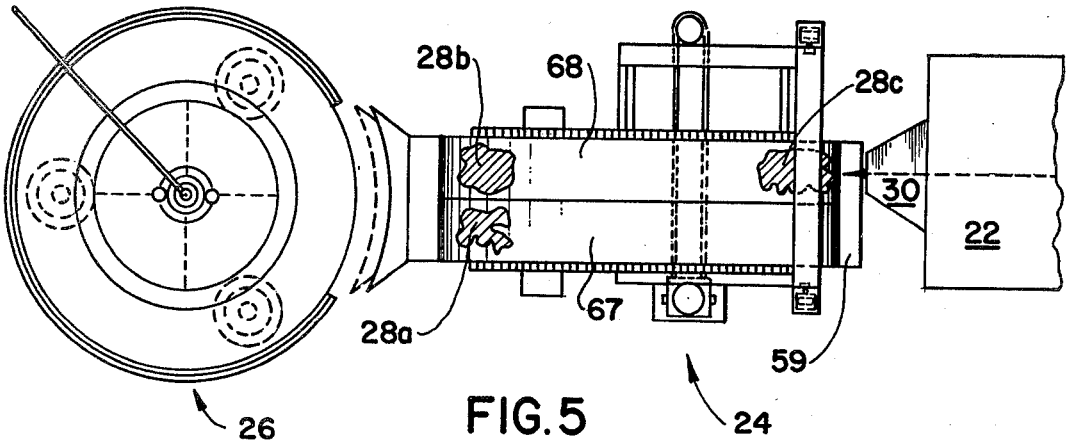
FIG. 5 is a plan view of the embodiment of the present invention shown in FIG. 4 after the conveyor belt has been rotated to a different position.

With the cam 134b in its third position, the conveyor belt motor 126b is operated by the conveyor belt relay 154, advancing the loads of laundry 28a and 28b from the position shown in FIG. 4 to the position shown in FIG. 5. When the photorelay 156 is operated by the positioning of the laundry loads 28a and 28b near the end of the conveyor belt 68 closest to the extractor 26, the switch 157 is closed and the timing motor 132 is stepped to position four causing the conveyor belt motor 126b to stop.

When a third laundry batch 28c is located on the transfer apparatus 24, as shown in FIG. 5, the photorelay 152 is again actuated, closing switch 153 and stepping the motor to position five. In step five, the cam 134a completes an electrical connection with the relay 150 causing the conveyor to move from the position shown in FIG. 5 to the laterally shifted position shown in FIGS. 3 and 6. Again this is under the control of the motor 126a through operation of the chain drive. When the fourth laundry load 28d is received and sensed by photorelay 148, the switch 149 is closed and the motor 132 steps to position number six.

In position number six, cam 134c moves the conveyor subassembly 47 longitudinally forward toward the extractor 26 due to the operation of the relay 158 which produces an electrical connection to the motor 126c which drives the pinion 61 on the rack gear 60. Operation of the first stage forward limit switch 160 halts this movement and indicates that the apparatus 24 has undergone the first stage of its forward longitudinal movement. As indicated in dot-dashed lines in FIG. 5, it is now in a position closer to but slightly spaced from the outer peripheral surface of the extractor 26. Moreover, the end 59 of the transfer apparatus 24 previously positioned under the slide 30 is now clear of the slide 30. The motor 132 is then stepped to position seven.

Figure 2:
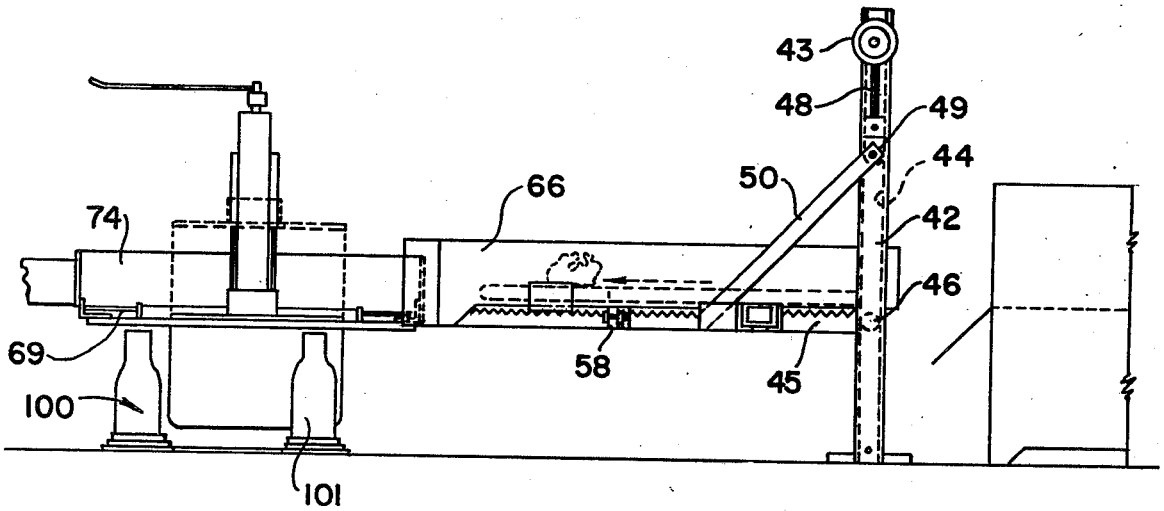
FIG. 2 is a partially sectioned, side elevational of the embodiment shown in FIG. 1 in its raised position.
Figure 6:
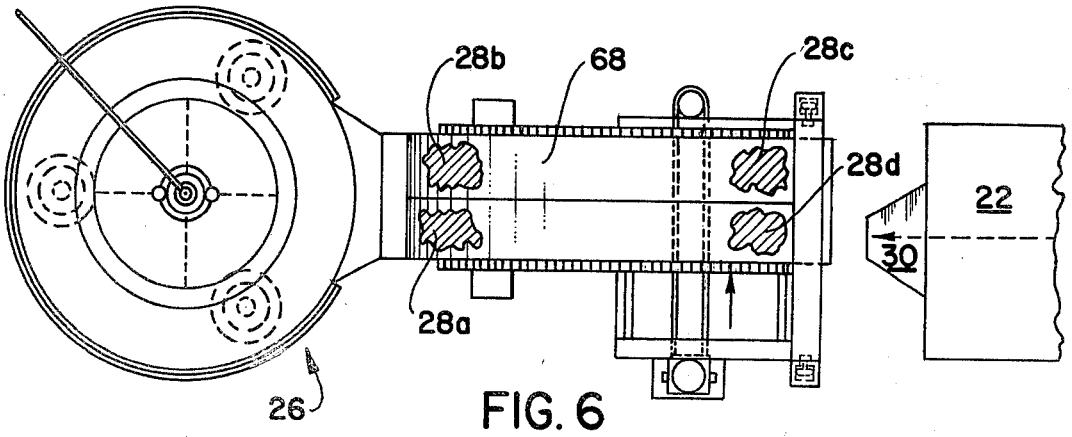
FIG. 6 is a plan view of the embodiment of the present invention shown in FIG. 5 shifted laterally, forwardly and vertically.

In position seven the cam 134d raises the conveying apparatus 24 from the position shown in dotted lines in FIG. 1 to the position shown in solid lines in FIG. 2. Since the apparatus 24 is now clear of the slide 30 no interference occurs. The upward movement of the assembly 45 continues until the up limit switch 162 is operated. This upward movement is achieved through the relay 161 that operates the winch 43 and particularly through the operation of winch motor 126i and chain drive 48. When the closure of the switch 162 is sensed, the relay 163 is operated and the subassembly 47 is again moved longitudinally toward the extractor 26, undergoing the second stage of its forward longitudinal movement, until the second stage limit switch 164 closes. When the switch 164 is operated the stepping motor 132 is stepped to position number eight. At this point, as shown in FIG. 6 and in dotted lines in FIG. 2, the conveyor free end 70 is aligned with the upstanding wall 74, the adjacent ramp portion 71 completing the barrier formed by the wall 74 and closing the opening 76 therein.

In position number eight, the cam 134e closes the switch formed between its contact 136 and contact 140. When the speed of rotation of the extractor basket 78 slows sufficiently, perhaps to 100 revolutions per minute, due to the opening of the extractor timer contacts, signaling the end of the extraction cycle, the low rpm switch 166 is closed, the unload pump motor 126d is then operated, a hydraulic valve is shifted as a result of current in the relay 168 and a time delay relay 170 is energized. The time delay relay 170 closes the contacts 172 actuating relay 173 to start the ring conveyor 72 motor 126g and the relay 175 to operate the blower motor 126e. The carrier 80 then raises from the position shown in FIG. 1 to the position raised over the drum, shown in FIG. 8, causing the laundry to be thrown onto the ring conveyor 72. The movement of the carrier 80 is due to the operation of the pump motor 126d that generates the needed fluid pressure, and a hydraulic valve which allows the fluid pressure to be conveyed to the actuator assembly 91. The vacuum suction motor 126f may then be operated, developing a vacuum in the draw off conveyor 69 and causing the laundry to be removed from the ring conveyor 72. The location of the carrier 80 in its full upward position operates the proximity switch 174 advancing the timing motor 132 to position number nine. After a predetermined period of operation the time delay relay 170 opens the contacts 172 shutting off the conveyor 72 and blower motor 126e.

The switch defined by the cam 134e is opened when the timing motor 132 moves to position nine, shutting off the pump motor 126d. The bleeding off of the fluid pressure generated in the actuator assembly 91 causes the carrier 80, excluding the curb 80, to move downwardly into the extractor 26. The cam 134f operates the relay 192 that actuates the cylinders 97 to retain the curb 84 in its raised position. As the carrier 80 reaches the down position, the photorelay 177 closes the switch 179 to step the motor 132 to position ten.

In position ten after the zero speed switch 170 closes, indicating that the extractor has stopped rotating, cam 134g operates the relay 181 and moves the subassembly 47 longitudinally forwardly, undergoing its third stage of forward longitudinal movement, to the position shown in FIG. 7, with its ramp portion 71 directly aligned over the compartments 88 in the extractor 26. The cam 134h then operates the relay 183 that starts the index motor 126h to rotate the extractor basket 78 until the index proximity switch 174 is operated, indicating that two compartments 88 are aligned under the transfer apparatus 24 and stepping the motor 132 to position eleven. In position eleven, the cam 134*h* opens a cam switch which stops the index motor 126*h*. The cam 134*b*, then closes the cam switch which starts the conveyor belt motor 126*b* to gravity unload the nearest two batches 28*a* and 28*b* from the transfer apparatus 24 into the adjacent and aligned compartments 88. This results in the photorelay 148 being deenergized, closing the contacts 180 and stepping the motor 132 to position twelve.

At this point the conveyor belt motor 126*b* is deenergized due to the operation of cam 134*b*. Cam 134*h* closes a cam switch and starts the index motor 126*h*, rotating the basket 78 by 180°, until the proximity switch 174 is operated stepping the motor 132 to position thirteen. In step thirteen, the cam 134*h* opens the cam switch to stop the indexing motor 126*h* and cam 134*b* closes the cam switch to start the conveyor belt motor 126*b* to unload the last two loads 28*c* and 28*d* into the two newly aligned compartments 88. The completion of loading of the extractor 26 is sensed by photorelay 156 which energizes and closes contacts 182 to step the motor 132 to its next position.

In position fourteen, cam 134*b* opens the cam switch to stop the conveyor belt motor 126*b* and cam 134*g* operates relays 146 and 147 to retract the subassembly 47 towards the washer 22. The movement of the subassembly 47 along the rack 60 continues until the second stage retract limit switch 188 is closed, stepping the motor 132 to position fifteen. Thus, the forward longitudinal movement accomplished in the second and third stages is reversed in a single stage retraction.

The assembly 45 is now lowered from the position shown in solid lines in FIG. 2 to the position shown in dotted lines in FIG. 1 due to the action of cam 134*d* which operates the lower relay 190. At the same time cam 134*f* disconnects the relay 192 and connects the vacuum pump relay 194 to operate the pump motor 126*k* and to lower the curb 84. When the curb 84 is in its lowered position, a photorelay 196 operates switch 197 and steps the motor 132 to position sixteen.

In position sixteen, the cam 134*c* closes the cam switch to longitudinally retract the assembly 47, once the down limit switch 198 is closed. Cam 134*c* energizes a time delay 200 to close the contacts 204 connecting a solenoid valve 202 to reset the extractor timer. The first stage retract limit switch 206 is closed by the subassembly 47 to step the motor 132 through positions 17 through 20 to position number 1. The apparatus 24 is then back in its original position, under the slide 30. At this point the apparatus is ready to recycle through the steps described previously.

The embodiment illustrated in FIGS. 9–11 may be implemented generally in manner described above. However, only a two stage longitudinal movement of the assembly 47 is required, the second of the three stages of movement described previously now being unnecessary. In addition unloading does not occur until the rotation of the basket 78 is stopped. Instead of actuating the ring conveyor 72 in step eight, the unloading mechanism 102 may be operated to sequentially engage each compartment 88 and to vacuum remove the batch 28 contained therein. Due to the sequential removal of these batches their discrete character is preserved by the unloading mechanism 102. In this way it is possible to process batches of laundry so that each batch is maintained in tact through out its processing. This facilitates sorting of the laundry and enables special treatment of certain batches.

In any case, the use of the segmented carrier 80 divides the laundry load into separated, sufficiently evenly weighted portions so that load imbalance problems are unlikely. The scraping action provided by the carrier 80 during its upward reciprocation frees the laundry from the basket 78 walls so that it may be easily unloaded.

Although only two methods and apparatus for automatically removing the laundry from the extractor after the completion of the extractor cycle have been described, it will be obvious that a number of different positive, automatic systems may be used in place of the methods and apparatus described herein to implement the present invention. For example, an air inflatable bag (not shown) may be located within the radially innermost position within each compartment 88 of the carrier 80 so that upon completion of an extraction cycle the carrier may be raised to its upward position and the bags may be sequentially inflated to displace the laundry from each of the compartments. An appropriate conveyor can be aligned to receive each batch of laundry as it is expelled by the air bag expulsion system. For example, a first batch of laundry may be expelled from the first compartment, the carrier may then be rotated to the same position at which expulsion previously occurred and the next batch may then be expelled. Alternatively, a "canvas" bag removal system (not shown) may be implemented by canvas bag that lines the innermost peripheral surfaces of each compartment. Upon completion of the extraction cycle and appropriate positioning of the carrier 80, as described previously, the bag may be pulled outwardly causing the laundry to be expelled. Still another alternative uses a mechanical arm (not shown), the carrier 80 being appropriately positioned to enable the robot arm to positively remove the laundry onto a suitable conveying system.

While the carrier 80 has been described as having four compartments 88 it will be obvious that the carrier may have any number of compartments. However, it is advantageous to use an even number of compartments to enable dual loading of the compartments. For most anticipated applications it is preferable to use four or six compartments with the present invention.

Although the motor control for the plant 20 is described herein as a cam actuated system, those skilled in the art will appreciate that a computerized or microcomputerized system may be used instead. Moreover, the computer control for the extractor 26 and the apparatus 24 may advantageously be combined with a washer 22 computer control system.

The foregoing detailed description has been given for clearness of understanding only and no unnecessary limitations should be understood therefrom as many modifications will be obvious to those skilled in the art.

What is claimed is:

1. A method for batch continuous extraction comprising the steps of:

continuously conveying a plurality of discrete laundry batches from a washing machine to a segmented, rotatable centrifugal extractor having a plurality of compartments;

aligning one of the laundry batches with one of said compartments;

continuously loading one of said batches of laundry automatically into each of the compartments of the segmented, rotatable centrifugal extraction drum;

rotating said drum for a period of time sufficient to remove the fluid from said laundry batches; and automatically expelling said laundry from each of said laundry compartments after said period of rotation is completed.

2. The method of claim 1 wherein the step of continuously conveying a plurality of laundry batches includes the steps of receiving a plurality of batches one at a time on a conveyor, displacing said conveyor to arrange a plurality of batches in an ordered array on said conveyor, and translating said conveyor and said batches to a position to load said batches into said extractor.

3. The method of claim 2 including the steps of receiving a first batch atop said conveyor, laterally translating said conveyor to a second position to receive a second batch in a position alongside the first batch, rotating said conveyor to advance said first pair of batches to a new position, and receiving a second pair of batches in the positions previously occupied by the first pair of batches.

4. The method of claim 3 including the step of loading a pair of batches into different compartments in said drum, two at a time.

5. The method of claim 1 including the step of automatically indexing said segmented extractor drum to receive said batches one after another into compartments within said drum.

6. The method of claim 1 wherein said loading step includes the steps of automatically uncovering the compartments of the extractor to enable said compartments to receive said batches, and thereafter automatically re-covering said carrier.

7. The method of claim 1 wherein said step of automatically expelling said laundry from each of said compartments includes the steps of raising a portion of said drum from a position within said extractor to a position over said extractor, elevating said laundry with said portion, and rotating said portion so as to expel said laundry from said portion.

8. The method of claim 7 including the steps of expelling said laundry onto a surrounding conveyor system, and conveying said laundry on said conveyor to a position away from said extractor.

9. The method of claim 1 wherein said automatic expelling step includes the step of applying a vacuum to each of the compartments within said drum to remove said laundry from each of said compartments.

10. The method of claim 9 including the step of indexing each of said compartments to a position to have a vacuum applied to its interior and applying a vacuum sequentially to each of said compartments to sequentially remove said laundry from said compartments.

11. The method of claim 10 including the steps of initially raising said laundry to a position over said extractor, and then sequentially vacuum extracting said laundry from each of said compartments.

12. An apparatus for batch continuous extraction that continuously centrifugally extracts fluid from sequentially received batches of laundry, the apparatus comprising:

a centrifugal extractor including a segemented drum divided into a plurality of compartments and a means for rotating said drum;

means for aligning a discrete batch of laundry with each compartment and means for automatically loading one of said discrete batches of laundry into each of said compartments; and means for automatically displacing said laundry from each of said compartments after a period of rotation of said drum.

13. The apparatus of claim 12 wherein said extractor drum rotates around a vertical axis and said drum includes a vertically reciprocatable carrier movable from a first position within the drum to a second position over the drum.

14. The apparatus of claim 13 wherein said carrier defines said plurality of compartments within said drum, each of said compartments having an open peripheral side.

15. The apparatus of claim 14 wherein said carrier is keyed to rotate with said drum.

16. The apparatus of claim 14 wherein said carrier includes a cover separable from the remainder of said carrier to enable said carrier to be loaded.

17. The apparatus of claim 12 wherein said automatic loading means includes a transfer mechanism including an endless belt conveyor and means for translating said mechanism in three dimensions.

18. The apparatus of claim 17 wherein said transfer mechanism includes means for arranging said sequentially received batches of laundry in an ordered array on said mechanism.

19. The apparatus of claim 18 wherein said arranging means arranges said batches in two rows.

20. The apparatus of claim 18 wherein said transfer mechanism includes means for arranging a plurality of batches on said mechanism equal in number to the number of compartments within said drum.

21. The apparatus of claim 18 wherein said endless conveyor belt includes a dividing means for dividing said conveyor belt into two separated regions.

22. The apparatus of claim 17 wherein said transfer mechanism includes means for automatically receiving said batches of laundry at one elevation, means for arranging said batches in an ordered array, means for elevating said batches to a second elevation and means for transferring said batches two at a time into said segmented drum.

23. The apparatus of claim 22 wherein said automatic loading means includes a photoelectric sensor for sensing the presence of said batches on said transfer mechanism.

24. The apparatus of claim 23 wherein said automatic loading means includes means for receiving a first batch of laundry at one level, means operative in response to receipt of said first batch of laundry, for shifting the position of said mechanism in the same plane.

25. The apparatus of claim 24 wherein said automatic loading means includes means for rotating said endless belt conveyor when first and second batches have been located on said mechanism in order to shift said batches to a new position on said conveyor and to enable said mechanism to receive another pair of laundry batches.

26. The apparatus of claim 25 including means for vertically shifting said conveyor in response to receipt of a number of batches of laundry equal to the number of compartments in said drum, and means for translating said mechanism with respect to said centrifugal extractor so as to position said batches to be received within said extractor.

27. The apparatus of claim 12 wherein said automatic displacing means includes means for centrifugally displacing said laundry from said extractor.

28. The apparatus of claim 27 wherein said centrifugal displacing means includes a vertically reciprocable carrier, translatable between a first position located within said drum and a second position raised over said drum, said carrier arranged to displace said laundry out of said drum, said carrier further including means for rotating said carrier when said carrier is displaced from said drum so as to expel said laundry therefrom.

29. The apparatus of claim 28 including a conveying system surrounding said extractor and arranged to receive said laundry from said automatic displacing means.

30. The apparatus of claim 29 wherein said conveying system includes a ring conveyor encircling said extractor.

31. The apparatus of claim 12 wherein said automatic displacing means includes a vacuum apparatus arranged to withdraw the laundry from each of said compartments.

32. The apparatus of claim 31 wherein said automatic displacing means includes a reciprocable carrier for displacing said laundry from the interior of said drum to a position raised over said drum, said carrier divided into a plurality of compartments, each of said compartments having an open peripheral side, said vacuum apparatus arranged to sealingly mate with said open peripheral side so as to withdraw the laundry from said compartment.

33. The apparatus of claim 32 wherein said vacuum apparatus includes a translatable head positionable in a first position spaced from said extractor and movable to a position mating with the open peripheral side of one of said compartments.

34. The apparatus of claim 33 wherein said head is automatically displaceable in response to the termination of the extraction cycle to a position to receive said laundry from at least one of said compartments, said rotating means including means for indexing each of said compartments to a position aligned with said vacuum apparatus.

35. A batch continuous laundry transfer apparatus for transferring serially received, discrete batches of laundry between first and second spaced laundry processing stations, such as a washer and an extractor, said apparatus comprising:

a conveying mechanism disposed between said first and second stations having a generally horizontal, laundry batch receiving surface;

means for automatically translating said mechanism with respect to said first station to arrange said serially received discrete batches in at least two side by side rows;

means for translating said mechanism from a position adjacent said first station to a position adjacent said second station;

means for aligning said rows of discrete batches with a pair of distinct compartments at said second station; and means for automatically loading said laundry batches into said compartments of said second station.

36. The apparatus of claim 35 wherein said conveying mechanism includes an endless belt conveyor mounted for translation in any dimension.

37. The apparatus of claim 35 wherein said automatic translating means includes means for shifting said conveying mechanism generally in a horizontal plane, perpendicularly with respect to the direction from which said batches are received by said mechanism.

38. The apparatus of claim 37 including first sensing means for determining when a first batch has been received on said surface and means for operating said shifting means when said sensing means senses said first batch.

39. The apparatus of claim 38 wherein said conveying mechanism includes an endless belt conveyor defining said surface, said apparatus including second sensing means for sensing when a pair of side by said batches have been received by said conveyor and means for indexing said endless belt conveyor when said second sensing means detects a pair of batches on said conveyor.

40. The apparatus of claim 39 including means for dividing said endless belt conveyor into a pair of separated portions.

41. The apparatus of claim 36 wherein said conveyor is translatable towards one of said stations in at least two discrete stages.

42. The apparatus of claim 35 wherein said automatic unloading means is arranged to feed said batches two at a time.

43. A method for transferring serially received discrete batches of laundry between first and second spaced processing stations, such as a washer and an extractor, said method comprising:

arranging a conveying mechanism to receive a plurality of batches of laundry on a surface of said mechanism, from said first laundry station, sensing the positioning of a first batch of laundry on said surface;

automatically laterally shifting said mechanism to receive a second batch of laundry beside said first batch of laundry when said first batch is sensed;

translating said surface to enable said mechanism to receive third and fourth laundry batches on said surface;

indexing said first and second laundry batches in alignment with two compartments disposed in a laundry processing device at said second station; and conveying said laundry from said first station to said second station to load said first and second laundry batches into said two compartments.

44. The method of claim 43 wherein the step of conveying said laundry from said first station to said second station includes the step of unloading said batches two at time into said second station.

45. The method of claim 44 including the step of translating said surface with respect to the remainder of said mechanism to move said batches from said mechanism to said second station.

46. The method of claim 42 wherein the step of conveying said laundry includes the step of elevating said conveyor to a position over said second station.

47. The method of claim 46 including the step of positioning said mechanism beneath at least a portion of said first station and translating said mechanism toward said second station in at least two stages.

48. An apparatus for batch continuous extraction that continuously centrifugally extracts fluid from sequentially received batches of laundry, the apparatus comprising:

a centrifugal extractor including a segemented drum divided into a plurality of compartments and a means for rotating said drum;

means for automatically loading a batch of laundry into each of said compartments; and means for automatically displacing said laundry from each of said compartments after a period of rotation of said drum, wherein said automatic displacing means includes a reciprocable carrier for displacing said laundry from the interior of said drum to a position raised over said drum, said carrier divided into a plurality of compartments, each of said compartments having an open peripheral side, and vacuum apparatus arranged to sealingly mate with said open peripheral side so as to withdraw the laundry from said compartment, wherein said vacuum apparatus includes a translatable head positionable in a first position spaced from said extractor and movable to a position mating with the open peripheral side of one of said compartments.

49. The apparatus of claim 48 wherein said head is automatically displaceable in response to the termination of the extraction cycle to a position to receive said laundry from at least one of said compartments, said rotating means including means for indexing each of said compartments to a position aligned with said vacuum apparatus.

50. A method for batch continuous extraction comprising:

continuously conveying a plurality of discrete laundry batches from a washing machine to a centrifugal extractor having a plurality of compartments;

continuously loading one of said batches of laundry automatically into each of the compartments of the segmented, rotatable centrifugal extraction drum;

rotating said drum for a period of time to remove at least a portion of the fluid from said laundry batches; and automatically expelling said laundry from each of said laundry compartments after said period of rotation by indexing each of said compartments to a position to have a vacuum applied to its interior and applying a vacuum sequentially to each of said compartments to sequentially remove said laundry from said compartments.

51. The method of claim 50 including the steps of initially raising said laundry to a position over said extractor, and then sequentially vacuum extracting said laundry from each of said compartments.

52. An apparatus for batch continuous extraction for extracting fluid from sequentially received batches of laundry, the apparatus comprising:

a centrifugal extractor including a segmented drum divided into a plurality of compartments and means for rotating said drum;

means for delivering a plurality of discrete batchs of laundry to said segmented drum;

means for aligning one of said discrete laundry batches with each compartment of said drum; and means for loading a discrete batch of laundry into each of said aligned compartments.

53. The apparatus of claim 52 wherein said extractor drum includes a vertically reciprocatable carrier movable from a first position within the drum to a second position over the drum.

54. The apparatus of claim 52 wherein said means for aligning said laundry batch with a compartment of said drum includes a conveyor disposed to deliver a discrete laundry batch to one or more predetermined areas aligned with said drum and means for rotating the drum to a predetermined position to dispose said compartment in alignment with said predetermined area.

55. The apparatus of claim 54 including means for rotating said drum in a step-wise fashion to index each compartment in alignment with one of said predetermined areas to deliver a discrete laundry batch to each of said compartments.

* * * * *